United States Patent [19]

Ruenzi

[11] 4,359,215

[45] Nov. 16, 1982

[54] DEVICE FOR FEEDING SHEETS OF PAPER TO A COPIER

[76] Inventor: Kurt Ruenzi, Kuesnachterstrasse 59, CH-8126 Zumikon, Switzerland

[21] Appl. No.: 181,678

[22] Filed: Aug. 27, 1980

[30] Foreign Application Priority Data

Sep. 7, 1979 [CH] Switzerland ..... 8075/79

[51] Int. Cl.[3] ..... B65H 3/30

[52] U.S. Cl. ..... 271/22; 271/162; 271/160

[58] Field of Search ..... 271/22, 162, 164, 160

[56] References Cited

U.S. PATENT DOCUMENTS

| | | | |
|---|---|---|---|
| 1,965,827 | 7/1934 | Duncan | 271/22 X |
| 4,017,181 | 4/1977 | Komaba | 271/162 X |
| 4,108,427 | 8/1978 | Komori | 271/162 X |
| 4,253,652 | 3/1981 | Steinhilber | 271/22 X |

*Primary Examiner*—Richard A. Schacher
*Attorney, Agent, or Firm*—W. G. Fasse; D. F. Gould

[57] ABSTRACT

A device for the feeding of single sheets, for example letterheads, to a xerographic copier instead of the paper supply from a roll. The device is located on a slide-in unit (1) and comprises an exchangeable cassette (4) which holds the supply stack (7). The base of the cassette (6) is tiltable and spring loaded so that the top sheet rests against two friction rollers (10) located above the supply stack (7). The rotation of the friction rollers (10) results in a separation of the sheets of paper by the corner-separators (13). Thereafter, the sheet of paper enters between sets of transport rollers (18, 19), which are magnetically pressed together, and then the sheet is taken over by the feed advance members of the copying apparatus.

7 Claims, 6 Drawing Figures

DEVICE FOR FEEDING SHEETS OF PAPER TO A COPIER

CROSS REFERENCE TO RELATED APPLICATION

The present application is based on Swiss Patent Application 8075/79-5; filed in Switzerland on Sept. 7, 1979. The priority of the Swiss filing date is claimed.

BACKGROUND OF THE INVENTION

The invention relates to a device for feeding sheets of paper to a copier, such as a xerographic type copier.

Numerous suggestions have been made for the feeding of single sheets, which are drawn off a supply stack and then fed to a copying apparatus. It is also known to supply the required paper from a continuous roll into a copier. However, the continuous roll type paper supply has the disadvantage that different preprinted forms may not be used at random in the copier. The rollers with the paper wound thereon usually provide plain paper or all the forms on a preprinted roll of paper are the same. This is a limitation of copiers having a continuous type paper supply drawn off from a roller.

OBJECTS OF THE INVENTION

In view of the above it is the aim of the invention to achieve the following objects singly or in combination:

- to modify a continuous roller type paper supply for a copier in such a manner that a stacked paper type supply may be used in the same copier by merely exchanging one type of paper supply for the other and vice versa;
- to modify existing copiers in such a manner that one type of paper supply may be easily exchanged against the other with a minimum of adjustments required to the copier itself; and
- to use the drive means normally available in a copier for driving the sheet advance means of the insert type sheet supply device.

SUMMARY OF THE INVENTION

According to the invention there is provided a device for feeding single sheets of paper into a copier equipped to normally receive its paper supply from a roll, comprising slide-in means (1) insertable into said copier, exchangeable paper stack support means (4) in said slide-in means, said paper stack support means comprising a movable bottom (6) and spring means operatively arranged for biasing said bottom against the weight of a stack of sheets resting on said bottom, positively drivable free wheeling friction roller means operatively arranged in said slide-in means for contacting the top sheet in a stack, transport roller means operatively arranged in said slide-in means downstream of said friction roller means as viewed in the feed advance direction, for receiving a sheet separated from a stack, and sheet separator means (13) operatively located between said friction roller means and said transport roller means for separating a sheet from the top of the stack.

Thus, it is possible to select a single sheet feeding, for example printed sheets of letterheads or the like, in a copier usually fed from paper rolls, whereby only slight readjustment operations must be carried out.

BRIEF FIGURE DESCRIPTION

In order that the invention may be clearly understood, it will now be described, by way of example, with reference to the accompanying drawings, wherein.

Figures 1, 2, 3, 4, 5, 6:
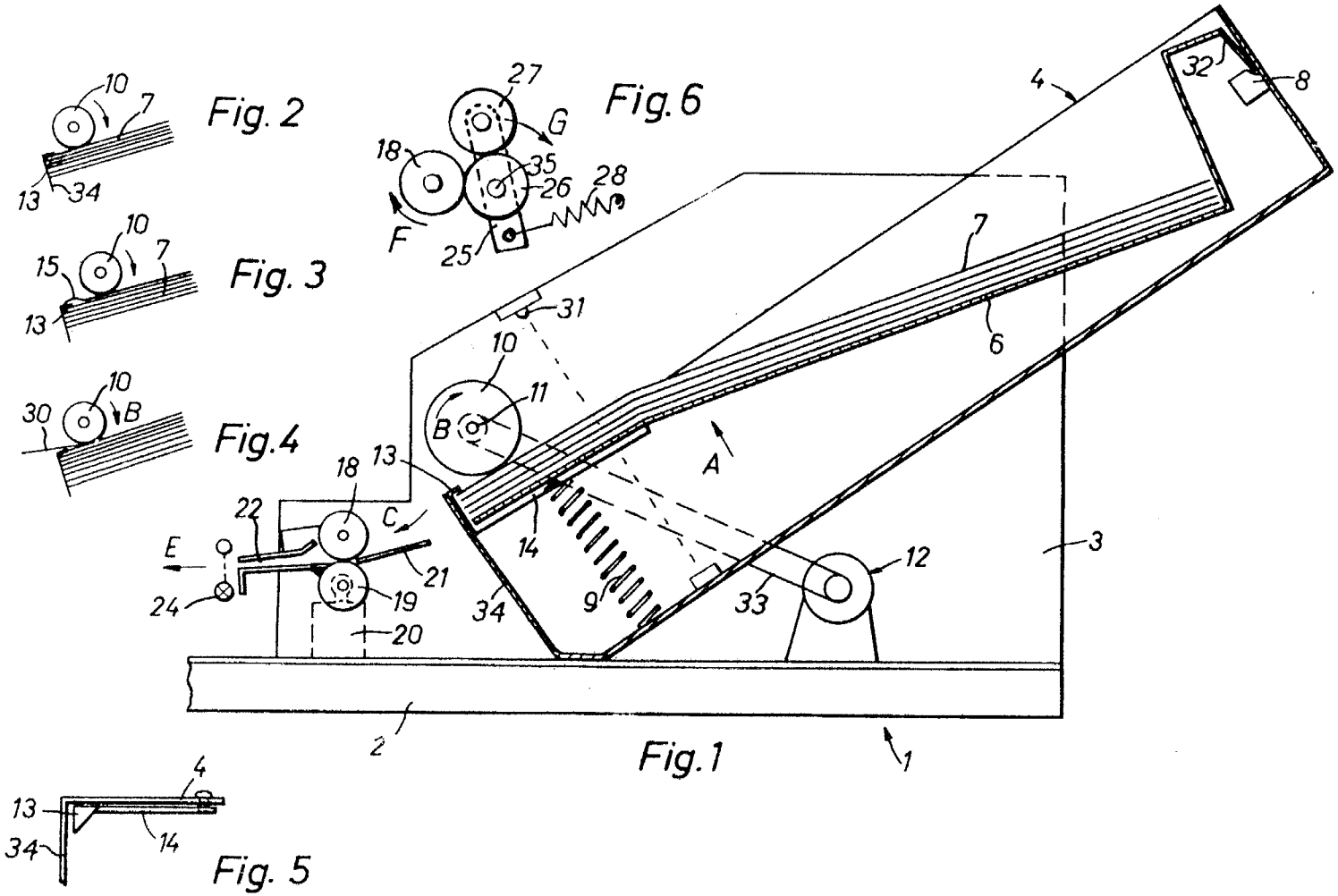
FIG. 1 is a side view of the insert type stacked paper feeding device according to the invention.
FIG. 2 is a side view of the downstream end of a stack of paper, as viewed in the feed advance direction, whereby the separation roller ist in contact with the top sheet of the stack and about to begin the sheet separation.
FIG. 3 is a view similar to that of FIG. 2 whereby the leading sheet edge has formed a bulge due to the fact that the separation roller has driven the leading edge against a separation means.
FIG. 4 is a view similar to that of FIG. 2, wherein the leading edge of the top paper sheet, due to its inherent elasticity and due to the continued push by the separator roller, has cleared the separator means.
FIG. 5 is a partial top view onto a sheet separator means in the form of a corner separator.
FIG. 6 is a side view of clutch means for the drive members of the copying apparatus.

DETAILED DESCRIPTION OF PREFERRED EXAMPLE EMBODIMENTS AND OF THE BEST MODE OF THE PRESENT INVENTION

The device serves to feed single sheets to a copier such as a xerographic copying apparatus. For this purpose, the device is constructed as a slide-in unit 1, that can be slid into the copying apparatus instead of the usual slide-in unit with paper on a roller. Skids 2, or rails with rollers, are located in the lowest zone of the slide-in unit 1 on which the slide-in unit 1 may be slid into the copying apparatus. The slide-in unit 1 comprises a frame with vertical side plates 3. A box type cassette 4, which serves to hold a paper stack 7, is exchangeably or detachably held in the slide-in unit 1 and is secured in its inserted end position by means of a locking lever or the like not shown since it will be the same element which also normally locks the slide-in unit carrying a roll of paper. The cassette 4 is inclined about 30° to 50° to the horizontal, preferably about 35°. A base plate 6 or intermediate plate which supports the paper stack 7 is tiltably or movably supported inside of the cassette 4 and is inclined about 20°–35° to the horizontal. The back end of the base plate 6 is angular and its rear end part 32 rests on a support bar 8 fixed at the inside of the cassette 4. The support bar 8 forms the axis of rotation of said base plate 6. The base plate 6 is biased in the direction of the arrow A by means of a spring 9, so that each time the top sheet of the supply stack 7 comes to rest against a feed or friction roller 10 or against a set of feed or friction rollers seated on axle 11 supported by the side plates 3. This axle 11 is driven by an electric motor 12 by a belt 33 when a corresponding switch-on signal comes from the copying apparatus or a light barrier 24. Preferably, two friction rollers 10, arranged near a leading edge of the cut sheets, are each provided with a friction facing made of soft rubber, or the like. The friction rollers 10 are arranged at a distance of 1 to 4 cm from the front edge 34 of the cassette 4.

A "corner-separator" is located at both corners of the front end 34 of the cassette 4 and has the function of a stopper for the sheets. This comprises, according to FIG. 5, a protruding substantially triangular corner piece 13 or separation pawls projecting from a tongue 14 which is movably supported about a horizontal axis in the cassette 4. The corner piece 13 can also be a fixed part at the front corners of the cassette 4.

The method of operation of this "corner-separator" may be seen from the FIGS. 2 to 4. When a single sheet at a time is to be separated from the stack 7 and transported in the direction of arrow C, a rotation in the direction of arrow B by the friction rollers 10, causes the top sheet to butt against the front side 34 of the cassette 4 which in turn causes the formation of a "bulge" 15, as shown in FIG. 3, because the transport of this sheet is at first hindered by the corner pieces 13. Upon further rotation by the friction roller or rollers 10, the top sheet 30 finally jumps up and over the corner piece 3, whereby a separation is achieved and a double transport of sheets is avoided, as shown in FIG. 4. Thereafter, the sheet of paper arrives between two sets of transport rollers 18, 19, of which at least one set—the upper or the lower—works together with an electromagnet 20, in the sense that when the electromagnet 20 is switched on, the rollers 18 and 19 are pressed against each other or against the sheet of paper between two rollers. In a state of rest, the two transport rollers 18, 19 have a mutual spacing, so that the separated sheet of paper may enter between this slit without any hindrance, whereby it glides onto a guide plate 21.

As shown in FIG. 6, one of the transport rollers 18 or 19 is driven by wheels and a further, tiltably supported gear wheel causes an engagement with the drive members of the copying apparatus. According to FIG. 6 the transport roller 18 or a wheel on the same shaft is driven by a wheel 26. A level 25 is pivotally supported on the shaft 35 of this wheel 26. A third wheel 27, cooperating with wheel 26 is turnably mounted at the upper end of this lever 25. The wheel 27 causes a clutch engagement with drive wheels of the copying apparatus if unit 1 is inserted into the copying machine. Thereby the lever 25 can move in the direction of arrow G against the effect of a spring 28. The wheels of this clutch are either friction wheels or gear wheels. After passing through between the set of transport rollers 18, 19, the sheet of paper is received by a guide channel 22 comprising two sheet strips of metal or plastic material. A light barrier 24 or a mechanical feeler, which checks for the presence or absence of a sheet of paper, is located in the area of the guide channel 22 or downstream of this guide channel 22. Another light barrier 31 is dedecting the presence of a supply stack 7. For this purpose an opening is provided in the base 6 of the cassette 4. The light barrier 31 causes an indication or signal if no sheets of paper remain on the base 6 of the cassette 4.

The mode of operation is as follows: A supply stack 7 of loose sheets of paper is laid onto the base plate 6 of a cassette 4 which is pulled out of a slide-in unit, whereby the front edges of the sheets of paper of this stack are located underneath the corner piece 13. Thereafter, the cassette 4 is pushed into the slide-in unit 1. The electric motor 12 is switched on, so that the friction roller means 10 with the friction facing, rotate in the direction of arrow B. Thus, the upper most single sheet of paper is pushed forward over the "corner-separator" 13 and arrives in the gap between the two transport rollers 18, 19 or roller sets. As soon as the light barrier 24 is reached by the front edge of the sheet of paper, it causes the power supply to the electric motor 12 to be interrupted, thereby stopping the friction rollers 10. When a copy is to be produced the two sets of transport rollers 18, 19 are driven by a gear or friction wheel inside the copying apparatus. The electromagnet 20 presses the two sets of transport rollers 18, 19 together and roller 18 is driven in the direction of arrow F, so that the sheet of paper lying between these transport rollers 18, 19 is transported in the direction of arrow E. This sheet of paper is then transported further by means of the copying apparatus' own rollers and conveying means in a known manner. The friction rollers 10 are provided with a free wheeling mechanism in the sense that these friction rollers 10 can rotate freely with the movement of a sheet of paper as it is pulled out even when the motor 12 is shut off. The separating mechanism, which is constructed as "corner-separators" in the present instance, is located in the space between the friction rollers 18, 19 and the friction roller 10. As soon as the rear end of the drawn-off sheet has passed by the light barrier 24 or an other feeler, a switching-on of the electric motor 12 is caused so that another sheet is drawn off the supply stack 7 in an analogous manner, whereby the mentioned operation repeats itself.

Althouth the invention has been described with reference to specific example embodiments, it is to be understood, that it is intended to cover all modifications and equivalents within the scope of the appended claims.

What is claimed is:

1. A device for feeding single sheets of paper into a copier, comprising slide-in means (1) insertable into said copier, exchangeable paper stack support means (4) in said slide-in means, said paper stack support means comprising a movable bottom (6) and spring means operatively arranged for pressing said bottom against the weight of a stack of sheets resting on said bottom, positively drivable free wheeling, friction roller means operatively arranged in said slide-in means for contacting the top sheet in a stack, transport roller means operatively arranged in said slide-in means downstream of said friction roller means as viewed in the feed advance direction, for receiving a sheet separated from a stack, and sheet separator means (13) operatively located between said friction roller means and said transport roller means for separating a sheet from the top of the stack and wherein said transport roller means comprise first gear wheel means forming part of said transport roller means and a second movably supported gear wheel operatively arranged for meshing contact with said first gear wheel means of said transport roller means and with drive gear means of said copier for transporting a sheet.

2. The device of claim 1, wherein said sheet separator means comprise corner separators.

3. The device of claim 2, wherein said corner separators are located at the downstream corners of said paper stack support means (4).

4. The device of claim 1, further comprising light barrier means operatively arranged downstream of said transport roller means.

5. The device of claim 1, wherein said exchangeable paper stack support means comprise cassette means, suspension means (8) in said cassette means for said movable bottom, said suspension means holding the upstream end of said movable bottom for a tilting movement so that the movable bottom normally assumes a tilted position of more than 10° relative to the horizontal.

6. The device of claim 1, and wherein said movably supported second gear wheel is tiltably arranged for meshing contact with said first gear wheels of said transport roller means and with drive gear means of said copier.

7. A feeding unit for cut sheets, comprising in combination, slide-in means (1) insertable into a copier, a box type cassette (4) having a front side (34), said box type cassette being detachably held in said slide-in means (1), a base plate (6) carrying a stack (7) of cut sheets, arranged in said cassette, spring means (9) operatively arranged for pressing the sheets in an upward direction, at least one friction roller means (10) operatively arranged above the stack for contacting the top sheet in said stack, separating means (13) arranged at the corners of said front side (34) of said cassette (4), transport roller means (18, 19) operatively arranged in said slide-in means downstream of said friction roller means (10) for receiving a sheet separated from said stack (7), means for moving said transport roller means (18, 19) to form a gap therebetween or to press and transport a sheet, feeler means (24) located downstream of said separating means (13) for checking the presence or absence of a sheet, first gear wheels means forming part of said transport roller means, and a second gear wheel movably supported for meshing with said first gear wheel means of said transport roller means and with drive gear means of a copier for transporting a sheet.

* * * * *